United States Patent [19]

Wallischeck et al.

[11] 4,278,010

[45] Jul. 14, 1981

[54] FLUID FLOW REGULATOR VALVE

[75] Inventors: Karl H. Wallischeck, Fairfield, Conn.; James H. Smith, Springfield, Pa.

[73] Assignee: United Technologies Corporation, Hartford, Conn.

[21] Appl. No.: 60,092

[22] Filed: Jul. 23, 1979

[51] Int. Cl.[3] ..... F15B 13/042

[52] U.S. Cl. ..... 91/420; 91/433; 91/468; 137/501

[58] Field of Search ..... 91/420, 468, 433; 137/501, 504, 503; 418/40

[56] References Cited

U.S. PATENT DOCUMENTS

| | | | |
|---|---|---|---|
| Re. 24,002 | 5/1955 | Beck | 91/433 X |
| 2,146,537 | 2/1939 | Farnham | 91/468 X |
| 2,255,787 | 9/1941 | Kendrick | 137/501 X |
| 2,570,351 | 10/1951 | Klessig | 137/501 X |
| 2,649,980 | 8/1953 | Slomer | 91/468 X |
| 3,641,880 | 2/1972 | Honeycutt | 91/420 |
| 3,742,970 | 7/1973 | Gross | 137/501 |
| 3,805,824 | 4/1974 | Robbins, Jr. | 137/504 |
| 3,807,443 | 4/1974 | Jacobs | 137/501 |

FOREIGN PATENT DOCUMENTS

| | | | |
|---|---|---|---|
| 2655900 | 7/1977 | Fed. Rep. of Germany | 91/468 |

*Primary Examiner*—Irwin C. Cohen
*Attorney, Agent, or Firm*—Vernon F. Hauschild

[57] ABSTRACT

A fluid flow regulator valve to regulate flow to a fluid driven prime mover wherein a selectively shaped, spring biased spool is positioned within a cylinder and has a sensor orifice therein to establish a pressure drop thereacross in response to controlled fluid flow rate and hence cause the spool to move within the cylinder to control both the metering orifice to and the return orifice from the flow conduit which connects the cylinder to the prime mover.

6 Claims, 1 Drawing Figure

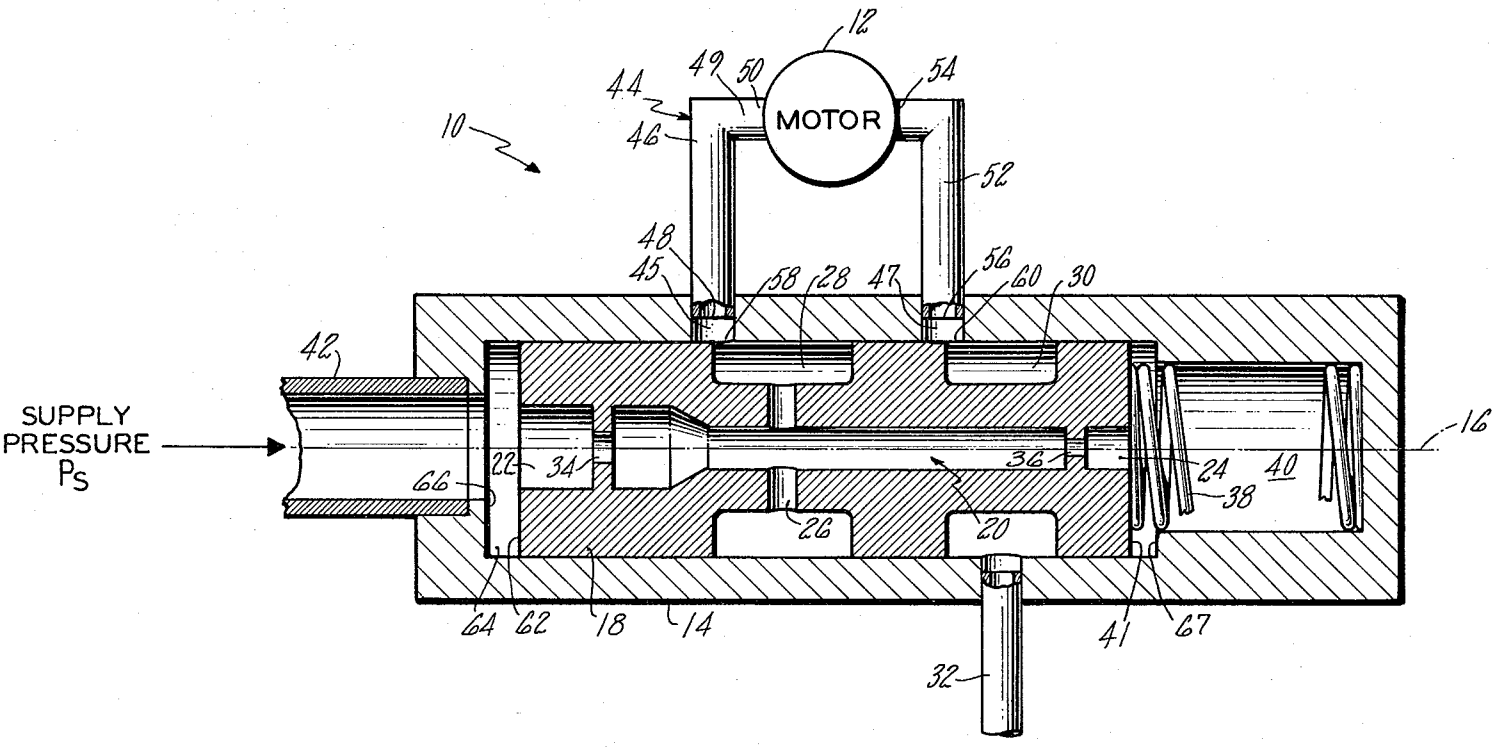
MOTOR
SUPPLY PRESSURE $P_S$

FLUID FLOW REGULATOR VALVE

The invention herein described was made in the course of or under contract or subcontract thereunder with the Department of the Navy.

BACKGROUND OF THE INVENTION

1. Field of Invention

This invention relates to a flow regulator valve and more particularly to a flow regulator valve in which a single spool positioned within a cylinder, responsive to a fluid flow sensing orifice therein, controls both the metering orifice to and the return orifice from the fluid conduit connecting the cylinder to the fluid driven prime mover under control to thereby cause the flow through the prime mover to be constant.

2. Description of the Prior Art

In the prior art, it has been conventional practice to use two flow regulators to so control the flow to and from a fluid flow operated prime mover, but this prior art construction has the disadvantage of difficulty in matching the operation of two such flow regulators, and the additional disadvantage of more parts and hence greater weight and complexity.

SUMMARY OF THE INVENTION

A primary object of the present invention is to provide a fluid flow control valve in which a single spool operating within a cylinder and responsive to a sensor orifice therein, responsive to the rate of flow of the controlled fluid positions the spool to meter the fluid flow to and from the fluid driven prime mover under control.

It is a further object of this invention to provide such a flow regulator valve which provides the fluid at a neutral pressure to the fluid driven prime mover under control, which neutral pressure is at a desired percentage of the fluid supply pressure for a given external load acting on the prime mover.

It is a further object of this invention to provide such a fluid flow regulator valve in which a single spool operating within a hydraulic cylinder acts as two back-to-back flow regulators to control fluid flow to and from the prime mover under control.

Other objects and advantages of the present invention may be seen by referring to the following description and claims, read in conjunction with the accompanying drawings.

BRIEF DESCRIPTION OF THE DRAWINGS

The single FIGURE is a cross-sectional showing of our fluid flow control valve.

DESCRIPTION OF THE PREFERRED EMBODIMENT

Referring to the drawing, we see fluid flow control regulator 10 which controls fluid flow to a single channel fluid driven prime mover, such as a single channel hydraulic ram or a single channel hydraulic motor 12. Regulator 10 includes hollow cylinder member 14, which is concentric about its longitudinal axis 16, and selectively shaped spool 18 positioned within cylinder 14 to form a hydraulic cylinder-spool arrangement therewith so as to define pressure chambers between the spool and the cylinder, and so that the spool can reciprocate axially within the cylinder. Positive stops 66 and

67 are provided in cylinder 14 to limit leftward and rightward motion of the spool 18, respectively.

Spool 18 has central passage 20 extending axially therethrough between its fluid inlet end 22 and its fluid outlet end 24. At least one lateral passage 26 connects central passage 20 to a first annular chamber 28, formed between spool 18 and cylinder 14 so as to be concentric about axis 16. A second such annular chamber 30 is similarly formed between cylinder 14 and spool 18 and is positioned so as to be in communication with fluid return flow conduit 32. Hydraulic chambers 28 and 30 are of the same dimensions so that they constitute hydraulically balanced areas when regulator 10 is in operation. Sensor orifice 34 is positioned within central passage 20 at the inlet end 22 thereof and upstream of lateral passage 26. While not necessary to this invention, damping orifice 36 may be positioned within central passage 20 between lateral passage 26 and fluid outlet end 24. Biasing spring 38 is positioned in sensor orifice controlled pressure chamber 40 and coacts with the chamber 40 fluid which acts against spool surface 41 to bias spool 18 leftwardly as shown in the drawing in opposition to the motive forces imposed upon spool 18 by the fluid pressure drop across sensor orifice 34. Supply pressure conduit 42 is connected to cylinder 14 at the upstream end 62 of spool 18, that is, at the end adjacent central passage inlet 22.

Fluid driven prime mover 12, which may be, for example, a single channel hydraulic ram or a hydraulic motor, is positioned in fluid control conduit 44, which comprises conduit 46, whose inlet end 48 communicates with annular chamber 28 and whose outlet end 50 connects to prime mover 12. Conduit 44 also includes conduit 52, whose inlet end connects to the scavenge side 54 of prime mover 12, and whose outlet end 56 communicates with chamber 30. Conduit 44 includes inlet 45, outlet 47 and central portion 49 therebetween. Annular chambers 28 and 30 are sized, positioned and shaped so that spool 18 cooperates with end inlet 45 to define metering orifice 58 between annular chamber 28 and conduit 46 and return orifice 60 between conduit outlet 47 and annular chamber 30.

In operation, actuating fluid, which is preferably liquid but which may be gas, is provided at supply pressure $P_s$ through conduit 42 into the interior of chamber 64 of hollow cylinder 14, from which fluid enters the inlet end 22 of central passage 20 of spool 18 and is discharged from the outlet end 24 of passage 20 into sensor orifice controlled pressure chamber 40, where the hydraulic fluid in chamber 40 coacts with biasing spring 38 to impose a force on spool 18 to cause leftward motion thereof as shown in the drawing. Fluid from central passage 20 also passes through lateral passage 26 into chamber 28, then through metering orifice 58 through conduit 46 to the prime mover 12 to actuate that prime mover, then from the prime mover 12 through conduit 52 and return orifice 60 into annular chamber 30, from which it is returned, preferably to supply, through return conduit 32.

In passing through central passage 20, the fluid passes through sensor orifice 34 to establish a pressure drop thereacross proportional, although not necessarily linear proportional, to the rate of fluid flow in conduit 44, to thereby generate a force due to this pressure drop across sensor orifice 34, thereby creating a pressure differential between supply pressure acting on surface 62 of spool 18 and fluid at lower pressure in chamber 40 acting on surface 68 to impose a net force on spool 18 which would cause rightward movement of the spool in opposition to the biasing spring 38. It is important to note that the pressure drop across sensor orifice 34 is proportional although not necessarily linear proportional to the flow through the sensor orifice, which is in turn proportional to the fluid flow though conduit 44 and prime mover 12. Spool 18 is designed so that the spool moving forces generated in annular chambers 28 and 30, balance out, as do the spool moving forces generated in chambers 64 and 40, so that, in practice for all practical purposes, the position of spool 18 is determined by the pressure drop across sensor orifice 34, as the force generated by the pressure drop at 34 is opposed by biasing spring 38.

It will therefore be seen that valve 10 controls the flow through prime mover 12 by selectively throttling both the inlet and outlet flow thereto through conduit 46 by controlling the size of metering orifice 58 and return orifice 60. This is accomplished by the force balance on spool 18. Accordingly, when the controlled flow in conduit 44 changes, the pressure drop across the sensing orifice 34 changes to reposition spool 18 to reestablish the desired flow through conduit 44.

In this fashion, spool 18 simultaneously throttles the flow at metering orifice 58 and return orifice 60 so as to cause the flow through conduit 44 and hence prime mover 12 to be constant, so that the speed or motion of the prime mover 12 is kept constant.

In the design of flow control regulator 10, the areas of metering orifice 58 and return orifice 60 are selected so that the neutral pressure of prime mover 12 is a selected percent of support pressure $P_s$, and within structural limits. This neutral passage of prime mover 12 occurs when the pressure at the inlet and outlet of prime mover 12 are equal, but not zero.

It is an important feature of our flow regulator valve 10 that it is insensitive to variations in supply pressure $P_s$ and to variations in loads on the prime mover 12. For example, when valve 10 is in normal operation, spool 18 may be positioned as shown in the drawing. When flow increases through sensing orifice 34, and hence through conduit 44 and the prime mover 12, the pressure drop across orifice 34 increases to move spool 18 to the right against the opposition of biasing spring 38, thereby reducing the areas of orifices 58 and 60 simultaneously, to reduce the flow through motor 12 so that the flow is kept constant and hence the speed of motor 12 is kept constant. If the flow through sensing orifice 34 were reduced, the pressure drop thereacross would also reduce permitting biasing spring 38 to move the spool 18 leftwardly to increase the size of orifices 58 and 60 and thereby increase the flow through the prime mover 12 so as to maintain the flow, through conduit 44 constant and hence the speed of the motor constant. These rate of flow changes through sensor orifices 34 can be caused by variations in supply pressure $P_s$, and hence it will be noted that our valve 10 continues to supply fluid at a constant rate of flow to the prime mover 12 despite variations in supply pressure $P_s$.

It is further important to the operation of our flow regulating valve 10 that it is insensitive to variations in the load imposed upon prime mover 12. For example, if the load on the prime mover 12 decreases, the flow through conduit 44 and hence through the sensing orifice 34 increases, to increase the pressure drop across the sensing orifice 34 to cause spool 18 to move to the right to reduce orifices 58 and 60 and thereby keep the rate of fluid flow through 44 and hence prime mover speed constant. Conversely, if the load on prime mover 12 has increased, the pressure drop across the prime mover increases thereby decreasing the flow through conduit 44 to decrease the pressure drop across sensing orifice 34 and permit spring 38 to move the piston to the left to open orifices 58 and 60 to maintain the rate of fluid flow through conduit 44 constant and hence prime mover 12 at the desired speed.

It will therefore be seen that our flow control valve 10 is insensitive to variations in supply pressure $P_s$ and to variations in the load on the prime mover 12.

Flow regulator 10 is designed so that prime mover 12 neutral pressure is a desired percent of supply pressure $P_s$. Netural pressure occurs when the pressure of the inlet and outlet ports to prime mover 12 are equal but not zero. At this neutral pressure, the prime mover 12 stops. This is how we stop the prime mover 12, whether it is a motor or a ram.

If desired, damping orifice 36 may be positioned within central passage 20 to avoid oscillation of spool 18 during operation.

We wish it to be understood that we do not desire to be limited to the exact details of construction shown and described, for obvious modification will occur to a person skilled in the art.

We claim:

1. In combination with a fluid actuated prime mover having a fluid inlet and a fluid outlet, a fluid flow regulator adapted to control fluid flow through said fluid actuated prime mover and comprising:

(A) a hollow cylinder, (B) a control fluid conduit having an inlet and an outlet communicating with the hollow cylinder interior, and a central portion joining the control conduit inlet to the inlet of said fluid actuated prime mover under control and the outlet of said fluid actuated prime mover back to the control conduit outlet, (C) a spool positioned within said cylinder for reciprocation therewithin and being selectively shaped to simultaneously establish the area of both the inlet and the outlet of said control fluid conduit, said spool defining opposed pressure chambers with said cylinder, means biasing said spool towards said control fluid conduit inlet, (D) said spool having a central fluid passage therein connected to said control fluid conduit so that the fluid which passes through the spool central passage is directed therefrom through said control fluid conduit and back to said hollow cylinder, said central fluid passage connecting said opposed pressure chambers, (E) said central passage having a sensor orifice therein so that as flow through the central passage and hence the control fluid conduit varies, the pressure drop across the sensor orifice varies to reposition the spool and thereby simultaneously vary the area of the inlet and the outlet of the control fluid conduit to maintain a constant rate of fluid flow through said control fluid conduit and said fluid actuated prime mover.

2. In combination with a fluid actuated prime mover having a fluid inlet and a fluid outlet, a fluid flow regulator adapted to control fluid flow through said fluid actuated prime mover and comprising:

(A) a hollow cylinder, (B) a control fluid conduit having an inlet and an outlet communicating with the hollow cylinder interior, and a central portion joining the control conduit inlet to the inlet of said fluid actuated prime mover under control and the outlet of said fluid actuated prime mover back to the control conduit outlet, (C) a spool positioned within said cylinder for reciprocation therewithin and being selectively shaped to simultaneously establish the area of both the inlet and the outlet of said control fluid conduit, (D) said spool having a central fluid passage therein connected to said control fluid conduit so that the fluid which passes through the spool central passage is directed therefrom through said control fluid conduit and back to said hollow cylinder, (E) said central passage having a sensor orifice therein so that as flow through the central passage and hence the control fluid conduit varies, the pressure drop across the sensing orifice varies to reposition the spool and thereby simultaneously vary the area of the inlet and the outlet of the control fluid conduit to maintain a constant rate of fluid flow through said control fluid conduit and said fluid actuated prime mover, and (F) further wherein:

(1) said hollow cylinder has a longitudinal axis, (2) said spool is positioned in said cylinder for reciprocation axially therewithin and, (a) said spool is shaped to cooperate with said cylinder to define first and second annular fluid pressure chambers therebetween concentric about said axis, (b) said spool is further shaped so that said central fluid passage extends axially therethrough and has a fluid inlet end and a fluid outlet end, and to further have at least one side passage extending from said central passage into said first annular chamber, (3) said sensor orifice being positioned in said central passage upstream of said side passage (4) means biasing said spool for motion in a first direction within said cylinder, (5) said control conduit inlet communicating with said first annular chamber, (6) said control conduit outlet communicating with said second annular chamber, (7) return flow conduit means communicating with said second annular chamber, (8) a fluid supply conduit connected to said cylinder to supply fluid to the fluid inlet end of said spool for passage through said central passage and through said side passage into said first annular chamber, then through said control fluid conduit and into said second annular chamber for discharge through said return conduit means, (9) means to supply fluid to said cylinder and spool through said fluid supply conduit to thereby establish a pressure drop across said sensor orifice to act in opposition to said biasing means to position said spool within said cylinder so as to simultaneously establish a metering orifice between said first annular passage and said control conduit inlet and a return orifice between said control conduit outlet and said second annular passage each of selected geometry to establish constant fluid flow through said control conduit so as to provide fluid to the prime mover at a constant rate, and further so that variations in fluid supply pressure and prime mover load will vary the fluid drop across the sensing orifice to cause reciprocation of the spool and thereby simultaneously adjust said metering orifice and return orifice so as to maintain constant flow through the control conduit and hence through the prime mover, and wherein said cylinder and spool cooperate to define a first fluid pressure chamber on the fluid inlet side of the spool central passage connected to receive fluid from said fluid supply conduit, and further cooperate to define a second fluid pressure chamber on the fluid outlet side of the fluid central passage to receive fluid from the sensor orifice to balance the spool moving forces so established in said first and second fluid pressure chamber, and wherein said biasing means is a spring member positioned in said second pressure fluid chamber and operable to bias said spool in a direction opposite to the spool moving force created by the fluid pressure drop across the sensor orifice.

3. A flow regulator valve according to claim 2 and including positive stop means positioned within said cylinder to limit the reciprocation of the spool therewithin.

4. A flow regulator valve according to claim 2 wherein the geometry of said control conduit inlet and outlet, and said spool are such that said metering orifice and said return orifice areas vary at the same rate as the spool reciprocates within the cylinder.

5. A fluid flow regulator valve according to claim 4 including a damper orifice positioned in said spool central passage downstream of said side passage.

6. A flow regulator according to claim 8 wherein said metering orifice and said return orifice are of selected geometry so that the prime mover neutral pressure is a desired percentage of fluid supply pressure.

* * * * *

UNITED STATES PATENT AND TRADEMARK OFFICE

CERTIFICATE OF CORRECTION

PATENT NO. : 4,278,010

DATED : July 14, 1981

INVENTOR(S) : Karl H. Wallischeck; James H. Smith

It is certified that error appears in the above—identified patent and that said Letters Patent is hereby corrected as shown below:

Column 3, Line 33 "passage" should be --pressure--

Column 6, Line 49 "8" should be --2--

Signed and Sealed this

*Twenty-second* Day of *June 1982*

[SEAL]

*Attest:*

GERALD J. MOSSINGHOFF

*Attesting Officer*

*Commissioner of Patents and Trademarks*